United States Patent [19]

Sunagawa et al.

[11] Patent Number: 4,559,289

[45] Date of Patent: Dec. 17, 1985

[54] ELECTROPHOTOGRAPHIC LIGHT-SENSITIVE MATERIAL

[75] Inventors: Hiroshi Sunagawa; Kazuhiro Kawajiri; Keishiro Kido; Toshio Iijima; Nobuharu Nozaki, all of Kanagawa, Japan

[73] Assignee: Fuji Photo Film Co., Ltd., Kanagawa, Japan

[21] Appl. No.: 627,693

[22] Filed: Jul. 3, 1984

[30] Foreign Application Priority Data

Jul. 4, 1983 [JP] Japan ..... 58-121387

[51] Int. Cl.[4] ..... G03G 15/04

[52] U.S. Cl. ..... 430/66; 430/57; 430/67

[58] Field of Search ..... 430/57, 66, 67

[56] References Cited

U.S. PATENT DOCUMENTS

| | | | |
|---|---|---|---|
| 4,361,638 | 11/1982 | Higashi et al. | 430/66 X |
| 4,394,425 | 7/1983 | Shimizu et al. | 430/67 X |
| 4,452,875 | 6/1984 | Ogawa et al. | 430/65 X |
| 4,465,750 | 8/1984 | Ogawa et al. | 430/57 |
| 4,483,911 | 11/1984 | Ogawa et al. | 430/84 X |
| 4,510,224 | 4/1985 | Yamazaki et al. | 430/57 |

FOREIGN PATENT DOCUMENTS

| | | | |
|---|---|---|---|
| 57-115559 | 7/1982 | Japan | 430/67 |
| 58-187935 | 11/1983 | Japan | 430/57 |
| 58-219559 | 12/1983 | Japan | 430/57 |

*Primary Examiner*—Roland E. Martin

*Attorney, Agent, or Firm*—Sughrue, Mion, Zinn, Macpeak, and Seas

[57] ABSTRACT

An electrophotographic light-sensitive material is described, comprising an electrically conductive support, an amorphous silicon photoconductive layer on the support, and a layer of amorphous material containing at least carbon and halogen atoms is provided on the photoconductive layer. This material is free from a serious reduction in resolving power as is encountered in conventional electrophotographic light-sensitive materials when they are exposed to corona discharge, particularly negative corona discharge under high temperature/humidity conditions.

16 Claims, No Drawings

ELECTROPHOTOGRAPHIC LIGHT-SENSITIVE MATERIAL

FIELD OF THE INVENTION

The present invention relates to an electrophotographic light-sensitive material. More particularly, it is concerned with an improved electrophotographic light-sensitive material utilizing amorphous silicon as a photoconductive substance.

BACKGROUND OF THE INVENTION

Photoconductive substances for use in a photoconductive layer of an electrophotographic light-sensitive material that have heretofore been known include inorganic compounds such as amorphous selenium, selenium alloys, and metal compound semiconductors (e.g., oxides, sulfides, and selenides of metals such as cadmium and zinc), organic polymers such as polyvinyl carbazole, organic compounds such as dyes and pigments, and the like. In recent years it has been proposed to use photoconductive amorphous silicon in the formation of a photoconductive layer for electrophotographic light-sensitive materials.

These electrophotographic light-sensitive materials utilizing amorphous silicon as a photoconductive substance basically comprise an electrically conductive support and a photoconductive layer provided on the support, said layer being made of amorphous silicon, which may also contain hydrogen and/or halogen atoms. The photoconductive layer of amorphous silicon is formed by techniques such as a method in which powdered amorphous silicon is dispersed in a binder and then applied onto an electrically conductive support, and a method in which a silicon-containing gas, such as silane and silane derivatives, is decomposed by glow discharge and deposited on an electrically conductive support.

However, electrophotographic light-sensitive materials consisting of an electrically conductive support and an amorphous silicon photoconductive layer alone exhibit various problems in the practical use thereof.

One of the problems is that upon application of corona discharge, particularly negative corona discharge under conditions of high temperature and high humidity (for example, during midsummer), a serious reduction in resolving power occurs. This reduction in resolving power occurs even if the formation of an oxidized layer of amorphous silicon is prevented by providing an overcoat layer on the amorphous silicon as disclosed in Japanese Patent Application (OPI) No. 115551/82 (the term "OPI" as used herein means a "published unexamined Japanese patent application"), and Japanese Patent Application No. 57975/83. Thus, this reduction in resolving power is entirely different from that due to the formation of an oxidized layer of amorphous silicon.

Such a reduction in resolving power and subsequent formation of dull images under high temperature/humidity conditions are very detrimental in electrophotography. It has therefore been desired to overcome the foregoing problems.

SUMMARY OF THE INVENTION

The present invention is intended to overcome the above-described problems, and therefore it is an object of the present invention to provide an electrophotographic light-sensitive material which is improved in its resistance to a reduction in resolving power due to corona discharge under high temperature/humidity conditions.

It has been found that this object is attained by providing a layer of amorphous material containing at least carbon and halogen atoms on the photoconductive layer of amorphous silicon.

Thus, the present invention relates to an electrophotographic light-sensitive material comprising an electrically conductive support, a photoconductive layer on the support, and a layer of amorphous material containing at least carbon and halogen atoms provided on the photoconductive layer.

DETAILED DESCRIPTION OF THE INVENTION

It is to be noted that the object of the present invention is attained provided that the layer of amorphous material is provided as the outermost layer on the photoconductive layer of amorphous silicon. Thus, one or more intermediate layers (e.g., a layer of amorphous silicon containing carbon atoms) may be provided between the layer of amorphous material and the photoconductive layer for various purposes described later. The provision of such an intermediate layer is particularly advantageous in that the desired performance can be increased.

The present invention prevents reduction in resolving power due to corona discharge under high temperature/humidity conditions. More specifically, by the present invention, a reduction in resolving power occurring by exposure to corona discharge even for a time as long as about 30 to 60 minutes can be entirely prevented.

The electrophotographic light-sensitive material of the present invention basically comprises an electrically conductive support and a photoconductive layer of amorphous silicon containing silicon and hydrogen atoms (hereinafter also referred to as the "amorphous silicon photoconductive layer"). This structure and a method for production of such an electrophotographic light-sensitive material of the structure are well known, for example, in U.S. Pat. No. 4,265,991.

For example, the amorphous silicon photoconductive layer is provided on a sheet of electrically conductive metals such as aluminum, chromium, and iron, or alloys thereof such as stainless steel, using compounds containing silicon and hydrogen or mixtures thereof as the starting material by techniques such as the glow discharge process, the sputtering process, the CVD process, and the ion plating process.

The present invention will hereinafter be explained with reference to a method for production utilizing glow discharge, which is a typical example of methods for production of electrophotographic light-sensitive materials utilizing amorphous silicon as a photoconductive substance.

In forming an amorphous silicon photoconductive layer by utilization of glow discharge, an electrically conductive support is placed in an atmosphere of gaseous compounds containing silicon atoms and hydrogen atoms and/or halogen atoms, such as silane or its derivatives, and glow discharge is generated in the atmosphere, whereupon the compound is decomposed and the resulting amorphous silicon is deposited on the support in a layer form.

Silane and its derivatives which can be used in the foregoing method include silane, disilane, trisilane, tetrasilane, silicoethylene, silicoacetylene, disiloxane, silylamine, monochlorosilane, dichlorosilane, trichlorosilane, tetrachlorosilane, hexachlorodisilane, octachlorotrisilane, decachlorotetrasilane, dodecachloropentasilane, monofluorosilane, difluorosilane, trifluorosilane, tetrafluorosilane, hexafluorodisilane, octafluorotrisilane, monobromosilane, dibromosilane, tribromosilane, tetrabromosilane, hexabromosilane, octabromotrisilane, monoiodosilane, diiodosilane, triiodosilane, tetraiodosilane, hexaiododisilane, octaiodotrisilane, and compounds containing a silicon atom and at least two halogen atoms in the molecule (e.g., $SiBrCl_3$ and $SiCl_2F_2$). These compounds can be used singly or in combination with each other. In addition, if desired (e.g., to achieve a desired hydrogen content), hydrogen gas can be used in combination therewith.

A typical procedure to form an amorphous silicon layer on the surface of a support by decomposing a silicon atom-containing compound by glow discharge is described below.

An electrically conductive support, the surface of which has been cleaned, is placed in a container of tight closed system, such as a bell jar. The container is evacuated and a glow discharge is produced on the surface of the electrically conductive support to remove gases adsorbed thereon. A silicon atom-containing compound gas (e.g., silane ($SiH_4$)) is introduced into the container, and glow discharge is conducted on the surface of the support under high vacuum conditions, thereby decomposing the silicon atom-containing compound, whereupon an amorphous silicon layer is formed on the surface of the support.

The thickness of the photoconductive layer of amorphous silicon is usually chosen to be within a range of from 5 to 100$\mu$.

In a particularly preferred embodiment of the present invention, an overcoat layer of low photoconductivity, which is made of amorphous silicon containing carbon atoms, preferably amorphous silicon containing from 5 to 90 atomic % carbon, is provided on the amorphous silicon photoconductive layer as formed above and then the layer of amorphous material containing at least carbon and halogen atoms is provided on the overcoat layer.

Such an overcoat layer of low photoconductivity can be formed, for example, by the following procedure:

An amorphous silicon photoconductive layer is first formed on an electrically conductive support in a container, such as a bell jar, in the same manner as described above. Then, a predetermined amount of a carbon atom-containing compound (desirably containing fluorine atom(s) therein) in a gaseous form is introduced into the container along with a silicon atom-containing compound gas. Glow discharge is conducted on the surface of the photoconductive layer under high vacuum conditions, thereby decomposing the silicon atom-containing compound and carbon atom-containing compound, whereupon a low-conductivity overcoat layer of amorphous silicon containing the above-specified amount of carbon atom is formed on the surface of the photoconductive layer.

The thickness of the overcoat layer of amorphous silicon containing carbon is usually chosen within the range of from 0.005 to 0.3$\mu$.

Examples of silicon atom-containing compounds which can be used for forming the overcoat layer include those silicon atom-containing compounds usable in the formation of the photoconductive layer as described above.

Examples of useful carbon atom-containing compounds include hydrocarbons having from 1 to 5 carbon atoms, such as methane, ethane, propane, n-butane, isobutane, n-pentane, isopentane, ethylene, propylene, 1-butene, isobutylene, 1-pentene, 2-pentene, acetylene, methylacetylene, and butyne, and halogenated alkyls having 1 to 5 carbon atoms, such as methyl fluoride, ethyl fluoride, propyl fluoride, methyl chloride, ethyl chloride, methyl bromide, ethyl bromide, methyl iodide, difluoromethane, dichloromethane, and hexafluoroethane. These compounds can be used singly or in combination with each other.

The layer of amorphous material can be prepared in the same manner as in the formation of the above-described low-photoconductivity overcoat layer. That is, the layer of amorphous material is prepared in the same manner as in the formation of the low-photoconductivity overcoat layer, except that hydrogen gas is mixed with the halogen atoms and carbon atom-containing compound gas in place of the silicon atom-containing compound gas, and glow discharge is conducted in the resulting mixed gas. The ratio of the flow rate of the hydrogen gas to the halogen atom and carbon atom-containing compound gas is from 2/8 to 8/2, and preferably from 3/7 to 7/3 by volume.

Examples of halogen atom and carbon atom-containing compounds include halogenated alkyls containing 1 to 6 carbon atoms, such as methyl fluoride, ethyl fluoride, propyl fluoride, methyl chloride, ethyl chloride, methyl bromide, ethyl bromide, methyl iodide, ethylene fluoride, methylene chloride, and hexafluoroethane. Of these halogenated alkyls, fluorinated hydrocarbons are particularly preferred in view of their effect. Particularly preferred is hexafluoroethane.

The thickness of the layer of amorphous material containing at least carbon and halogen atoms is generally from a thickness corresponding to a monoatomic layer to 30 microns, and preferably is 3 microns or less (i.e., it is preferably from a monoatomic layer thickness to 3 microns thick).

The present invention is described in detail with reference to the following non-limiting examples.

EXAMPLE 1

The following operation was conducted using a bell jar type glow discharge apparatus for production of amorphous silicon, equipped with a vacuum unit, a gas-supplying conduit unit, a gas leak unit, a heater, a glow discharge unit, etc.

An aluminum drum, i.e., a support (outer diameter: 120 mm; length: 410 mm), the surface of which had been abraded, was set on a quartz plate mounted on a rotary support in the bell jar. The bell jar and also the gas-supplying conduit unit provided to the bell jar were evacuated to adjust a degree of vacuum in the units to about $3\times10^{-5}$ torr (mmHg).

The aluminum drum was heated with the heater provided inside the bell jar while controlling the temperature at 250° C. This control in temperature was performed while measuring the temperature of the drum with an alumel/chromel thermocouple.

Then, by slightly opening a leak valve, the degree of vacuum in the bell jar was controlled to about 0.3 torr, and 30 watt glow discharge was caused between the aluminum drum and a gas blow-off plate for 5 minutes by the use of a negative pulse high voltage electric source to remove gases adsorbed on the surface of the drum. The high voltage electric source was switched off, the leak valve was closed, and then the bell jar was again set at a degree of vacuum of about $1\times10^{-5}$ torr.

A $B_2H_6/H_2$ mixed gas (hydrogen content, 290 ppm (by volume)) was introduced from the gas-supplying conduit unit into the bell jar while controlling the flow rate to 4 ml/min (SCCM) with a mass flow meter. Also, an $SiH_4$ gas was introduced while controlling the flow rate to 150 ml/min with a mass flow meter by gradually opening a valve of the $SiH_4$ gas-supplying conduit unit. During this operation, the pressure in the bell jar was maintained at $4.5\times10^{-1}$ torr by controlling a by-pass valve.

When the flow rates of the gases supplied became constant, glow discharge was applied for 5 hours between the rotating drum and the gas blow-off plate at an input power of 100 W to form an amorphous silicon photoconductive layer.

Prior to the start of formation of an overcoat layer, the gas-supplying conduit unit was closed to adjust the degree of vacuum in the bell jar to $1\times10^{-5}$ torr.

When the degree of vacuum in the bell jar reached $1\times10^{-5}$ torr, the mass flow meter for the $SiH_4$ gas-supplying conduit unit was set at 30 ml/min, and the mass flow meter for the $C_2F_6$ gas-supplying conduit unit was set at 8 ml/min. Under these controlled conditions, the gases were introduced into the bell jar. Then, when the degree of vacuum in the bell jar reached $5\times10^{-3}$ torr, the mass flow meter for the $SiH_4$ gas-supplying conduit unit was controlled to 150 ml/min, and the mass flow meter for the $C_2F_6$ gas-supplying conduit unit was controlled to 32 ml/min. When the flow rates of the gases reached the set points, the pressure in the bell jar was adjusted to $4.5\times10^{-1}$ torr.

Then, glow discharge was conducted for 6 minutes at an input of 100 W by the use of a high voltage electric source to form an overcoat layer.

The high voltage electric source was switched off to stop glow discharge. When the pressure in the bell jar reached $5\times10^{-2}$ torr, the bell jar was further evacuated for 10 minutes to adjust the degree of vacuum to $1\times10^{-5}$ torr. Then the temperature of the drum was set at 100° C. by switching off the heater. While maintaining the drum temperature at 100° C., $H_2$ was introduced from the gas-supplying conduit unit into the bell jar at a flow rate of 40 ml/min. This flow rate was controlled with the mass flow meter. By gradually opening the valve of the $C_2F_6$ gas-supplying conduit unit, a $C_2F_6$ gas was introduced into the bell jar at a flow rate of 40 ml/min. During this operation, the pressure in the bell jar was adjusted to $4.5\times10^{-1}$ torr by controlling the by-pass valve.

When the flow rates of the gases became constant, an AC electric field (input, 500 W; 100 KHz) was applied between the rotating drum and the gas blow off plate to cause glow discharge. This glow discharge was conducted for 20 minutes to form a surface-modifying layer.

The high voltage electric source was switched off to stop glow discharge. When the pressure in the bell jar reached $5\times10^{-2}$ torr, the bell jar was further evacuated for 10 minutes to adjust the degree of vacuum to $1\times10^{-5}$ torr. Then the heater was switched off. When the temperature of the drum reached 100° C., the drum was taken out of the bell jar.

The thus-prepared light-sensitive material is designated as a "light-sensitive material (A)".

Another light-sensitive material, a light-sensitive material (B), was prepared in the same manner as in the production of the light-sensitive material (A), except that in the formation of the surface-modifying layer the flow rate of $C_2F_6$ was changed to 50 ml/min, and the flow rate of $H_2$ was changed to 30 ml/min.

Another light-sensitive material, a light-sensitive material (C), was prepared in the same manner as in the production of the light-sensitive material (A), except that the formation of the surface-modifying layer the flow rate of $C_2F_6$ was changed to 30 ml/min, and the flow rate of $H_2$ was changed to 50 ml/min.

A light-sensitive material (D) was the same as the light-sensitive material (A) except that the surface-modifying layer was not provided.

In the light-sensitive material (A), the C/(Si+C) value (atomic %) in the overcoat layer was 33%.

The light-sensitive materials (A), (B), (C) and (D) were each exposed to corona discharge (+6 KV; charging time, 0.08 second) under the conditions of a temperature of 30° C. and a relative humidity 85% and then immediately subjected to imagewise exposure of 1.5 lux·sec. A dry developer comprising negatively chargeable toners and carriers was placed on the drum surface of the light-sensitive material and transferred to a transfer paper by means of plus corona discharge, whereupon there was obtained an image which was very sharp, i.e., was of high resolving power and high density.

A corona charging deterioration test at a temperature of 30° C. and a relative humidity (RH) of 85% was performed as follows:

Each light-sensitive material was mounted on a rotary charging test apparatus, was subjected to corona charging of −6 KV for 10 and 30 minutes while rotating at a rate of revolution of 40 per minute in order to estimate the results of repeated corona charging on the materials and, thereafter, processed under the same conditions according to the same image-forming process as described above, whereupon there was obtained a copied image. This copied image was measured for its resolving power (sharpness). The results are shown in Table 1.

TABLE 1

| Resolving Power after Minus Corona Charging | | |
|---|---|---|
| | Minus Corona Charging Time | |
| Light-Sensitive Material | 10 Min (lines/mm) | 30 Min (lines/mm) |
| A | 6 | 6 |
| B | 6 | 6 |
| C | 6 | 6 |
| D | 0 | 0 |

The figures in the table indicate the number of distinguishable lines per 1 mm.

Corona charging of 10 minutes at a rate of revolution of 40 per minute corresponds to electrophotographic operations to obtain 100 to 400 copy sheets.

It can be seen from Table 1 that with the light-sensitive materials (A), (B) and (C) with a surface-modifying layer provided thereon, even after minus corona charging in an environment of 30° C. and 85% RH, a sufficiently satisfactory resolving power can be obtained, whereas with the light-sensitive material (D), with no surface-modifying layer provided thereon, if minus corona charging is performed even for only 10 minutes by the use of a rotary charging apparatus, a serious reduction in resolving power occurs.

A corona charging deterioration test was performed at +6 KV by the use of a rotary charging apparatus in the same manner as described above. The results are shown in Table 2.

TABLE 2

| Light-Sensitive Material | Resolving Power after Plus Corona Charging Plus Charging Time 10 Min (lines/mm) | 30 Min (lines/mm) | 60 Min (lines/mm) |
|---|---|---|---|
| A | 6 | 6 | 6 |
| B | 6 | 6 | 6 |
| C | 6 | 6 | 6 |
| D | 2 | 0 | 0 |

It can be seen from Table 2 that with the light-sensitive materials (A), (B) and (C) with a surface-modifying layer provided thereon, a sufficiently satisfactory resolving power can be obtained, whereas with the light-sensitive material (D) with no surface-modifying layer provided thereon, if +6 KV corona charging is performed even for only 10 minutes by the use of the rotary charging apparatus, a serious reduction in resolving power occurs.

EXAMPLE 2

Light-sensitive materials (E) and (F) were prepared in the same manner as in the production of the light-sensitive materials (A) and (D), respectively, in Example 1 except that the flow rate of the $SiH_4$ gas was changed from 150 ml/min to 60 ml/min, and the flow rate of the $C_2F_6$ gas changed from 32 ml/min to 40 ml/min.

The C/(Si+C) (atomic %) in the overcoat layer of the light-sensitive material was 57%.

Each light-sensitive material was exposed to minus corona discharge for 10 minutes by the use of the rotary charging apparatus at a temperature of 30° C. and an RH of 85%, and thereafter was measured for resolving power in the same manner as in Example 1. The results are shown in Table 3.

TABLE 3

| Light-Sensitive Material | Minus Corona Charging Time 10 Min (lines/mm) |
|---|---|
| E | 6 |
| F | 0 |

It is apparent from Table 3 that the effect of the present invention can be obtained even if the carbon content of the overcoat layer is high.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising an electrically conductive support, an amorphous silicon photoconductive layer further comprising hydrogen and/or halogen on the support, and a layer of amorphous material consisting essentially of carbon and halogen atoms provided on the photoconductive layer, wherein a low-photoconductivity amorphous silicon overcoat layer containing carbon atoms is provided between the amorphous silicon photoconductive layer and the layer of amorphous material comprising substantially carbon and halogen atoms.

2. An electrophotographic light-sensitive material as in claim 1, wherein said overcoat layer contains from 5 to 90 atomic % carbon.

3. An electrophotographic light-sensitive material as in claim 1, wherein the thickness of the overcoat layer is from 0.005 to 0.3μ.

4. An electrophotographic light-sensitive material as in claim 2, wherein the thickness of the overcoat layer is from 0.005 to 0.3μ.

5. An electrophotographic light-sensitive material as in claim 1, wherein the layer of amorphous material containing at least carbon and halogen atoms is provided by a glow discharge deposition wherein the ratio of the flow rate of hydrogen gas to halogen atom and carbon atom-containing compound gas is from 2/8 to 8.2.

6. An electrophotographic light-sensitive material as in claim 2, wherein the layer of amorphous material containing at least carbon and halogen atoms is provided by a glow discharge deposition wherein the ratio of the flow rate of hydrogen gas to halogen atom and carbon atom-containing compound gas is from 2/8 to 8.2.

7. An electrophotographic light-sensitive material as in claim 3, wherein the layer of amorphous material containing at least carbon and halogen atoms is provided by a glow discharge deposition wherein the ratio of the flow rate of hydrogen gas to halogen atom and carbon atom-containing compound gas is from 2/8 to 8/2.

8. An electrophotographic light-sensitive material as in claim 1, wherein the layer of amorphous material containing at least carbon and halogen atoms is provided by a glow discharge deposition wherein the ratio of the flow rate of hydrogen gas to halogen atom and carbon atom-containing compound gas is from 3/7 to 7/3.

9. An electrophotographic light-sensitive material as in claim 2, wherein the layer of amorphous material containing at least carbon and halogen atoms is provided by a glow discharge deposition wherein the ratio of the flow rate of hydrogen gas to halogen atom and carbon atom-containing compound gas is from 3/7 to 7/3.

10. An electrophotographic light-sensitive material as in claim 3, wherein the layer of amorphous material containing at least carbon and halogen atoms is provided by a glow discharge deposition wherein the ratio of the flow rate of hydrogen gas to halogen atom and carbon atom-containing compound gas is from 3/7 to 7/3.

11. An electrophotographic light-sensitive material as in claim 1, wherein the thickness of the layer of amorphous material containing at least carbon and halogen atoms is from a monoatomic layer to 30 microns.

12. An electrophotographic light-sensitive material as in claim 2, wherein the thickness of the layer of amorphous material containing at least carbon and halogen atoms is from a monoatomic layer to 30 microns.

13. An electrophotographic light-sensitive material as in claim 3, wherein the thickness of the layer of amorphous material containing at least carbon and halogen atoms is from a monoatomic layer to 30 microns.

14. An electrophotographic light-sensitive material as in claim 1, wherein the thickness of the layer of amorphous material containing at least carbon and halogen atoms is from a monoatomic layer to 3 microns.

15. An electrophotographic light-sensitive material as in claim 2, wherein the thickness of the layer of amorphous material containing at least carbon and halogen atoms is from a monoatomic layer to 3 microns.

16. An electrophotographic light-sensitive material as in claim 3, wherein the thickness of the layer of amorphous material containing at least carbon and halogen atoms is from a monoatomic layer to 3 microns.

* * * * *